US008636768B2

(12) United States Patent
Rohrig

(10) Patent No.: US 8,636,768 B2
(45) Date of Patent: Jan. 28, 2014

(54) PACIFIER HAVING A NIPPLE

(75) Inventor: Peter Rohrig, Vienna (AT)

(73) Assignee: Mam Babyartikel Gesellschaft m.b.H., Vienna (AT)

( * ) Notice: Subject to any disclaimer, the term of this patent is extended or adjusted under 35 U.S.C. 154(b) by 85 days.

(21) Appl. No.: 13/055,644

(22) PCT Filed: Jun. 24, 2009

(86) PCT No.: PCT/AT2009/000251

§ 371 (c)(1),
(2), (4) Date: Jan. 24, 2011

(87) PCT Pub. No.: WO2010/009484

PCT Pub. Date: Jan. 28, 2010

(65) Prior Publication Data

US 2011/0125190 A1 May 26, 2011

(30) Foreign Application Priority Data

Jul. 23, 2008 (AT) ..... A 1143/2008

(51) Int. Cl.
*A61J 17/00* (2006.01)

(52) U.S. Cl.
USPC ..... 606/234; 606/235; 606/236

(58) Field of Classification Search
USPC ..... 606/234, 235, 236
See application file for complete search history.

(56) References Cited

U.S. PATENT DOCUMENTS

| | | | | |
|---|---|---|---|---|
| 4,324,249 | A | 4/1982 | Sundkvist et al. | |
| 5,403,349 | A | 4/1995 | Rohrig | |
| 5,578,058 | A | 11/1996 | Chen | |
| 6,241,110 | B1 * | 6/2001 | Hakim | 215/11.1 |
| 6,699,264 | B1 * | 3/2004 | Rohrig | 606/234 |
| D607,573 | S | 1/2010 | Roehrig et al. | |
| D612,945 | S | 3/2010 | Roehrig et al. | |
| 2001/0047189 | A1 * | 11/2001 | Griffith | 606/234 |
| 2003/0163162 | A1 * | 8/2003 | Uehara et al. | 606/234 |
| 2007/0021782 | A1 | 1/2007 | Inoue et al. | |

FOREIGN PATENT DOCUMENTS

| | | | |
|---|---|---|---|
| AT | 338 440 | B | 8/1977 |
| AT | 379 508 | B | 1/1986 |
| DE | 25 27 040 | A1 | 12/1976 |
| DE | 3117348 | A1 | 12/1982 |
| DE | 3232101 | A1 | 9/1983 |
| DE | 202004013985 | U1 | 1/2005 |
| FR | 590 147 | A | 6/1925 |
| GB | 188844 | A | 11/1922 |
| GB | 239676 | A | 9/1925 |
| WO | 2004/103258 | A1 | 12/2004 |

OTHER PUBLICATIONS

International Search Report: PCT/AT2009/000251 mailed May 10, 2009.
Austrian Search Report.
EPO Examination Report dated Aug. 28, 2013; Appln. No. 09 775 547.4-1651

* cited by examiner

*Primary Examiner* — Katherine Dowe
*Assistant Examiner* — Kevin Everage
(74) *Attorney, Agent, or Firm* — Ladas & Parry LLP

(57) ABSTRACT

A pacifier having a nipple, which can be fastened to the pacifier guard with a stem-shaped end, wherein on the pacifier guard a fastening part that is or can be connected to the pacifier is provided on a side provided for placing the lips thereon such that the pacifier is connected to the pacifier guard when the fastening part is fastened to the pacifier guard.

18 Claims, 6 Drawing Sheets

PACIFIER HAVING A NIPPLE

The invention relates to a pacifier with a teat that is attached to a pacifier shield via a shaft-shaped end.

The teat of a pacifier is usually attached with the aid of a member that can be fit onto the outer face, i.e. the face of the pacifier shield facing away from the teat. The fit-on member usually comprises a plug or stopper by which the teat is clamped between the pacifier shield and the plug. In general, this way of attaching teats to pacifiers has proven successful, as shown in AT 338 440 B, for example.

Further pacifiers in which the teat is attached by a member to be fit onto the outer face of the pacifier shield are known, for example, from AT 379 508 B, U.S. Pat. No. 4,324,249 A and DE 31 17 348 A.

It is a disadvantage thereof, however, that due to the attaching member being fit onto the outer face of the pacifier shield, the centre of gravity of the pacifier in the position of being received by the mouth is relatively far away from the mouth, so that especially with newborn babies, whose sucking power is still developed relatively weak, the pacifier may tilt over and drop from the mouth because of the centre of gravity being arranged far from the mouth.

It is, hence, an object of the present invention to create a pacifier which substantially prevents such dropping from the mouth due to the centre of gravity's being arranged comparably far outside the oral cavity in the used position. Moreover, a pacifier is to be created, the pacifier shield of which has a relatively large front face to be seen in the used condition of the teat.

In the pacifier of the type mentioned above, this is achieved according to the invention by providing on the pacifier shield, on a face intended for the lips to be placed thereon, an attaching member that is connected and/or connectable to the teat, so that when the attaching member is attached to the pacifier shield, the teat is connected to the pacifier shield. By providing an attaching member arranged on the teat for attaching the teat to the pacifier shield, the centre of gravity of the pacifier will, in contrast to known pacifiers, be moved towards the mouth when inserted into the mouth, so that the tilting momentum and, subsequently, the risk of an accidental dropping of the pacifier is reduced, in particular with newborns, who can only apply little sucking power to the teat. Further advantageously, it will not be possible for the infant to disconnect the pacifier shield from the attaching member by biting with high effort and thus effect a detachment of the parts, which is dangerous for the infant. In addition, this will also lead to preventing gaps in the outer face of the shield, which often contain deposits of dirt. Furthermore, various shapes of pacifier shields may be combined with the attaching member provided on the teat, thus achieving a modular system comprising a small number of total parts. Moreover, if a pacifier shield with a solid face is provided, the "buttonless" configuration of the pacifier shield's front face, which can be seen in the used condition, will exhibit a comparably large face available for graphic design to make the appearance of the teat appealing. This includes, for example, applying a large-area print or a large-area engraving, incorporating foils during the manufacture of the pacifier shield, etc.

Regarding a simple attachment of the attaching member to the pacifier shield, it is favourable if the attaching member can be snapped on in a recess in the pacifier shield. Of course, the pacifier shield and the attaching member could also be connected to each other by welding or an adhesive connection.

If a clamping member with a through opening for the shaft-shaped end of the teat is provided as an attaching member, so that, when the attaching member is attached to the pacifier shield, the teat is being clamped between attaching member and pacifier shield, the shaft-shaped end of the teat may be passed through the through opening in the attaching member in a simple manner, and thus a clamping attachment between teat and pacifier shield may be achieved at the same time as the attaching member is attached to the pacifier shield.

In order to achieve a form-fit connection between the teat and the attaching member in addition to the frictionally engaged teat and pacifier shield, it is favourable for an attaching flange on the end face of the teat to be arranged in a cavity between pacifier shield and attaching member when the attaching member is attached to the pacifier shield.

A particularly reliable engagement of attaching member and teat is provided when the attaching member and the teat, which is made of a soft material compared to the attaching member, are formed integrally as a two-component injection-moulded part. By integrally forming the attaching member and the teat, a particularly flat configuration of the pacifier shield is also possible, as no space for receiving the clamped-in end section of the teat is required in the pacifier shield.

If a hollow teat is provided, it is favourable for the attachment of the hollow teat if the pacifier shield comprises a plug that projects into an attaching opening of the teat. Of course, however, it is also possible for the attaching member to attach a teat made of a solid material to the pacifier shield, in particular one having a one-walled shaft-shaped end section. Regarding a constructionally simple configuration for attaching the hollow teat to the pacifier shield, it is advantageous for the plug to be formed integrally with the pacifier shield.

Regarding a high user convenience, providing a contact surface that is gently curved and as free of steps as possible in the region of the lips of the baby using the pacifier, it is advantageous for the attaching member to have a lip-contact plate, the lip-contact surface of which faces the teat and is arranged in alignment with the inner face of the pacifier shield when attached to the pacifier shield.

If the distance between the lip-contact surface and an outermost elevation of the pacifier shield is smaller than 15 mm, preferably smaller than 12 mm, in particular substantially between 5 mm and 11 mm, the pacifier shield and/or its bulge are designed to be comparably flat, so that the tilting momentum, which causes the pacifier to drop when weak sucking power is applied, is kept small in an advantageous manner.

Regarding a constructionally simple snap connection between the attaching member and the pacifier shield, it is advantageous for the attaching member to have at least one attaching rib extending substantially vertically to the lip-contact plate in order to snap-connect to the pacifier shield.

If knob-shaped elevations are provided on the lip-contact surface of the attaching member, the lip-contact surface does not rest fully on the lips of the baby using the pacifier, so that skin irritations can be prevented.

Advantageously, the attaching member comprises at least one projection, which extends through a recess in the pacifier when the attaching member is attached to the pacifier shield, wherein preferably a handle portion is attached to the projection. By providing a projection extending through the recess in the pacifier shield, a handle portion or the like can be attached to the pacifier shield in a simple manner, the arrangement of which further secures the attaching member in the position of attachment to the pacifier shield at the same time.

For attaching a handle portion or the like, it is particularly favourable for at least two ribs to be provided as the projection. In this case, in particular regarding a simple attachment of the attaching member in the pacifier shield, it is advantageous for the ribs to extend substantially vertically to the lip-contact plate.

For attaching a handle portion to the two ribs, it is favourable for each of the ribs to comprise an attaching hole in the freely cantilevering end region.

Regarding a pivotable handle bow having a high degree of user friendliness, it is favourable for the attaching holes of the ribs to receive attaching pins of the handle portion to facilitate pivotably mounting a bow-shaped handle portion.

As an alternative to a pivotable bow-shaped handle portion, it is conceivable for a substantially U-shaped handle portion to be snapped onto the ribs. In this case, regarding a constructionally simple attachment of the U-shaped handle portion to the ribs, it is advantageous for the arms of the U-shaped handle portion to comprise slit-shaped openings on their end faces for snap-connecting to the ribs.

Subsequently, the invention will be discussed in more detail by way of preferred exemplary embodiments illustrated in the drawings, however, without limiting the scope of the invention to these embodiments. In the figures of the drawings.

Figure 1:
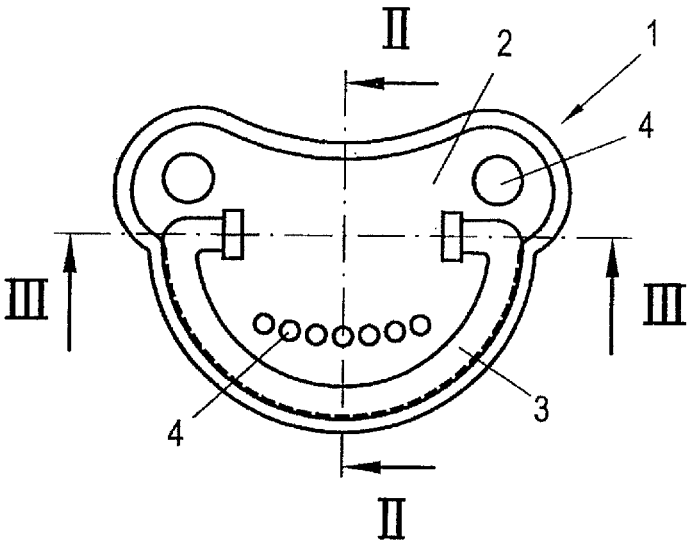
FIG. 1 is a view of the pacifier with a pivotably mounted handle portion.
Figure 2:
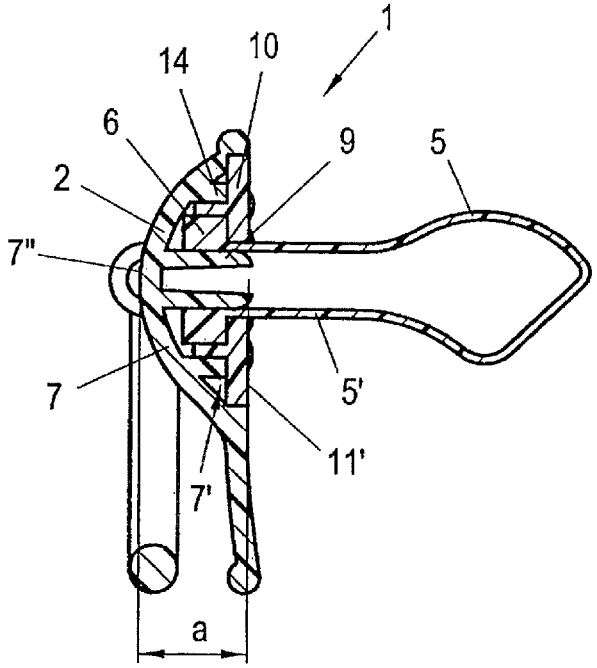
FIG. 2 is a section view of the pacifier according to line II-II in FIG. 1.
Figure 2A:
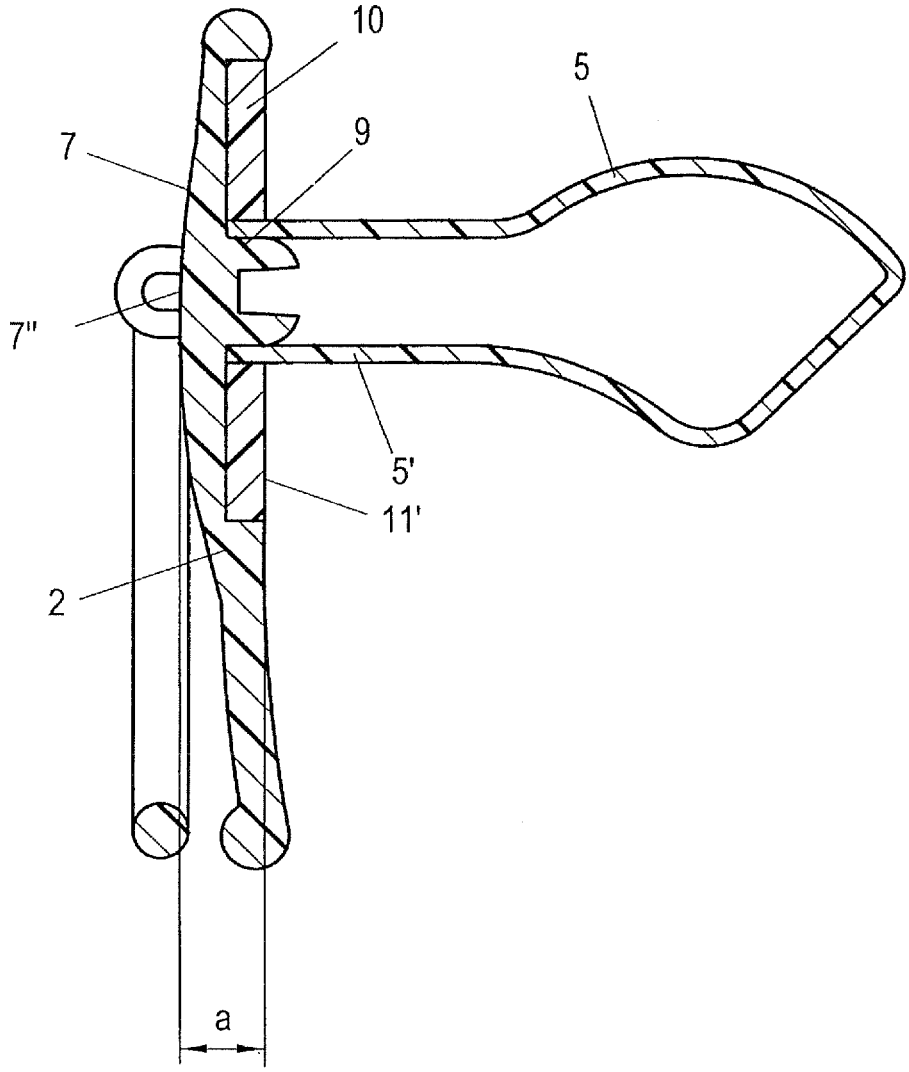
Figure 3:
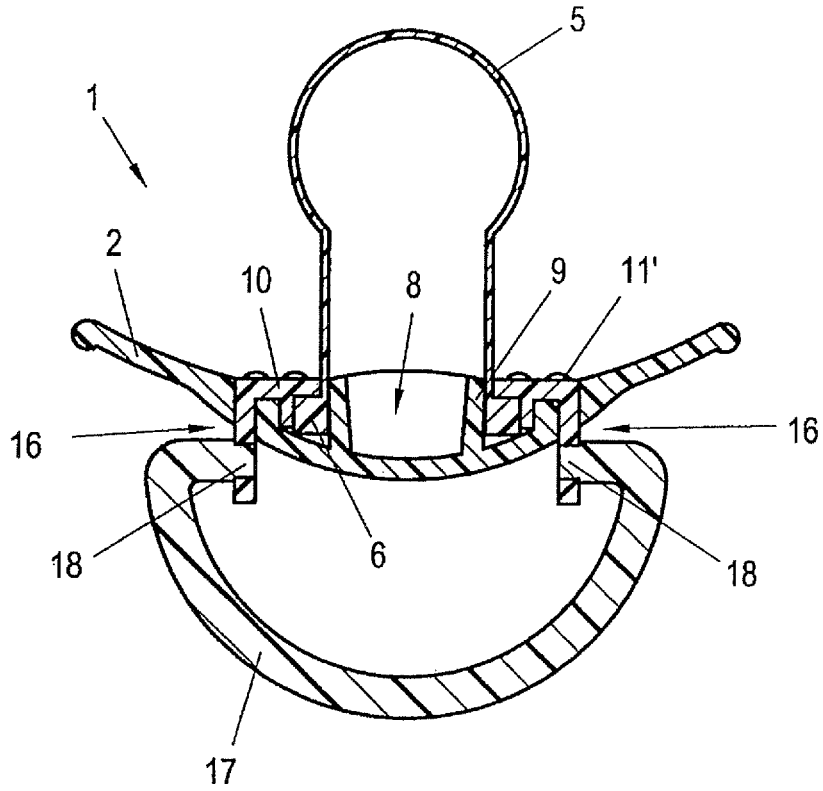
Figure 7:
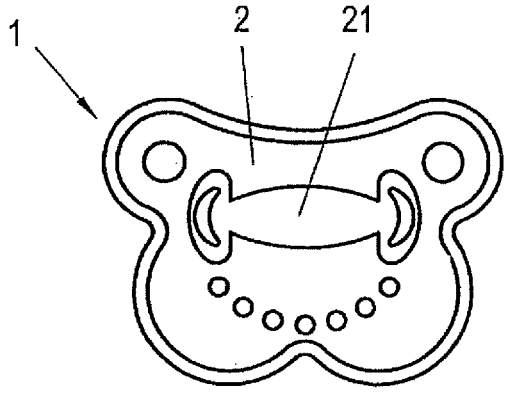
Figure 8:
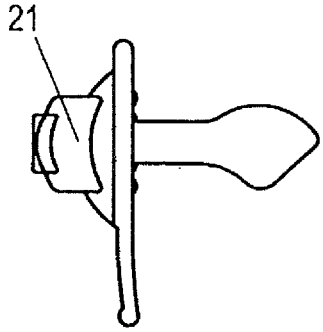
Figure 5:
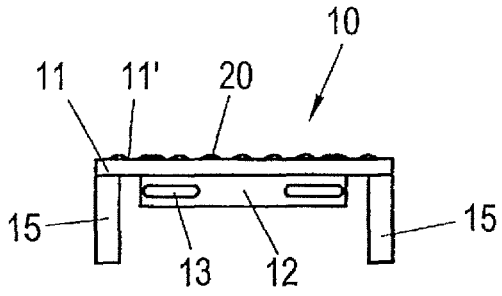
Figure 6:
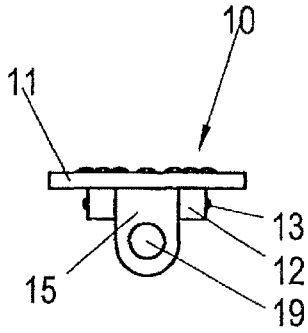
Figure 4:
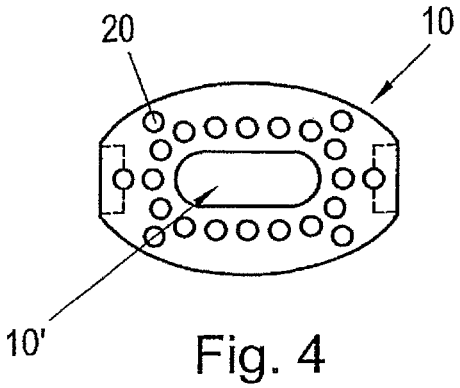
Figure 9:
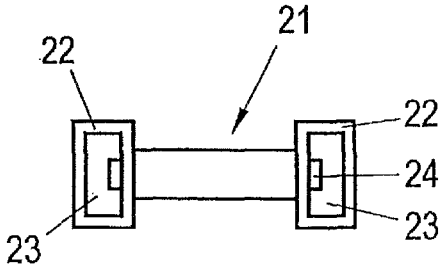
Figure 10:
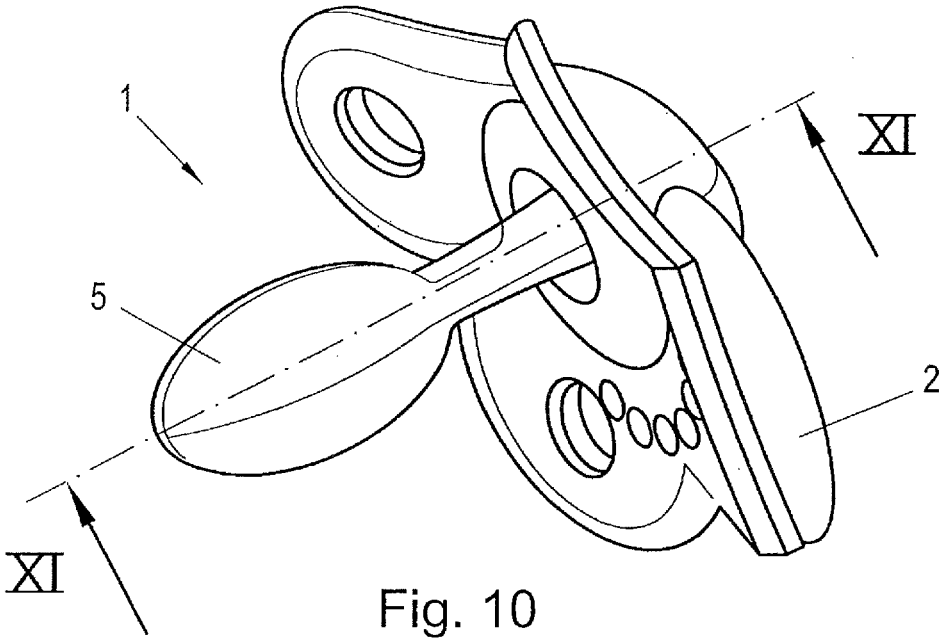
Figure 13:
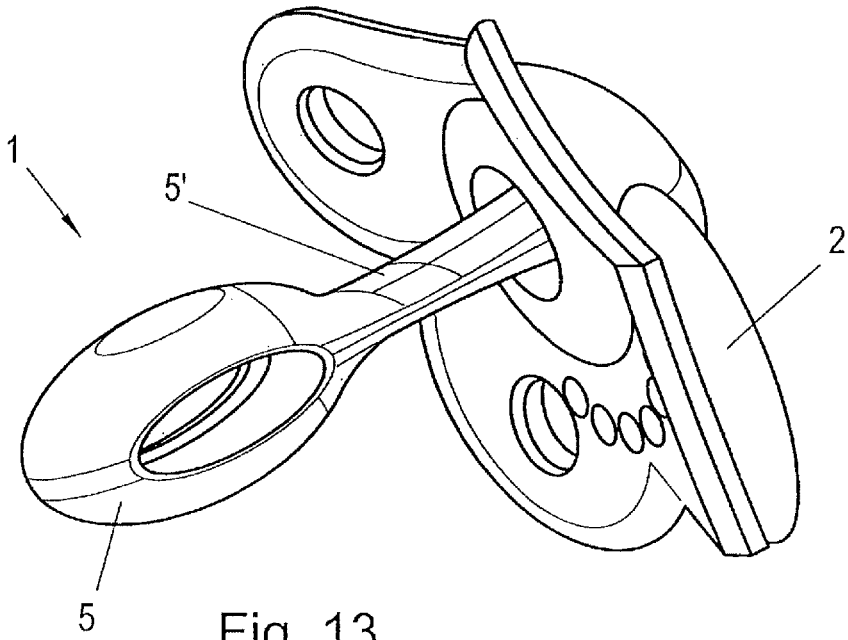
Figure 11:
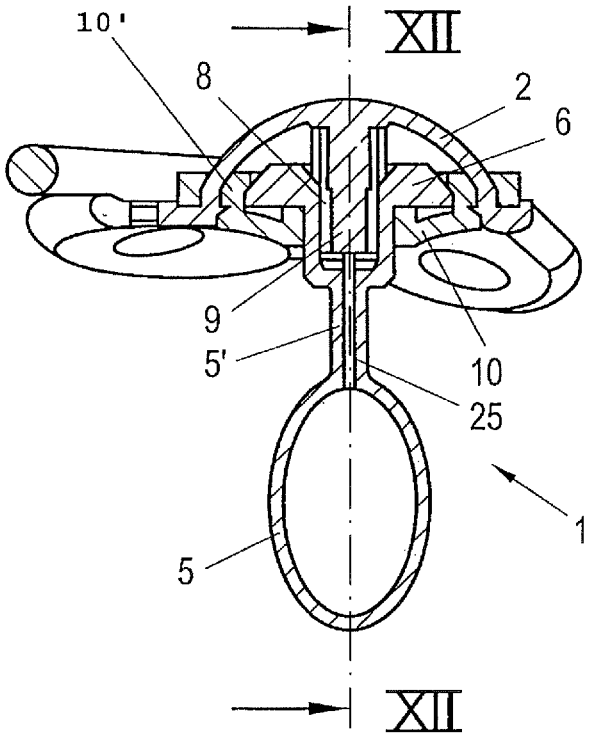
Figure 12:
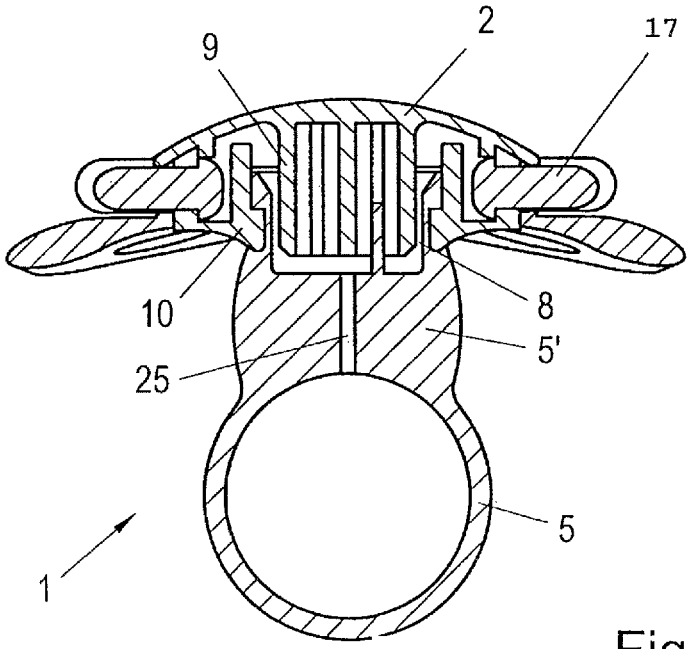

FIG. 2*a* is a sectional representation of an alternative exemplary embodiment;

FIG. 3 is a section view according to line in FIG. 1;

FIG. 4 is a view of an attaching member to be inserted into the pacifier shield at the side of the teat;

FIG. 5 is a side view of the attaching member according to FIG. 4 from the longitudinal side of the attaching member;

FIG. 6 is a side view of the attaching member according to FIG. 4 from a narrow side of the attaching member;

FIG. 7 is a view of an alternative exemplary embodiment with a U-shaped handle portion;

FIG. 8 is a side view of the pacifier according to FIG. 7;

FIG. 9 is a view of the U-shaped handle portion;

FIG. 10 is a perspective view of a pacifier with a shaft that is solid in its cross-section;

FIG. 11 is a section view according to line XI-XI in FIG. 10;

FIG. 12 is a section view according to line in FIG. 11;

FIG. 13 is a perspective view of an alternative exemplary embodiment of a teat with a shaft that is solid in its cross-section.

In FIG. 1, a pacifier 1 with a pacifier shield 2 can be seen, on which a bow-shaped handle portion 3 is pivotably mounted. In addition, it can be seen that the pacifier shield 2 comprises a plurality of ventilation holes 4.

As can best be seen in FIGS. 2 and 3, a teat 5 with its shaft-shaped end 5', comprising an attaching flange 6, is attached to the pacifier shield 2. Herein, the flatly formed pacifier shield 2 comprises a plug 9 extending into an attaching opening 8 of the teat 5 in a bulge 7 intended to receive the attaching flange 6. For clamping attachment of the teat 5 to the pacifier shield 2 an attaching member 10 (cf. FIGS. 4 to 6) is snapped onto the pacifier shield 2 in the recess 7' that is formed by the bulge 7 of the pacifier shield, the attaching member having a central through opening 10', through which the teat 5 can extend.

To achieve this, the attaching member 10, as can best be seen in FIGS. 4 to 6, comprises an attaching rib 12 extending from a lip-contact plate 11 towards the pacifier shield 2 and surrounding the central through opening 10' in the exemplary embodiment shown. Herein, the attaching rib 12 comprises four projecting snap-on lugs 13, which are arranged circumferentially spaced around the annular rib 12 and snap into corresponding grooves of an annular attaching rib 14 of the pacifier shield 2.

In addition to this, the attaching member 10 has two ribs 15 extending substantially vertically from the lip-contact plate 11, which are passed through corresponding recesses 16 in the pacifier shield 2 when the attaching member 10 is in the inserted position, as can best be seen in FIG. 3. Thus, attachment of a bow-shaped handle portion 17 is possible on the outer face of the pacifier shield, i.e. the face that is facing away from the teat 5. For pivotably mounting the bow-shaped handle portion 17, attaching pins 18 of the handle portion 17 are inserted into attaching holes 19 of the ribs 15 (cf. particularly FIG. 6) as a simple way of achieving this. With the aid of the handle portion 17 the attaching member 10 is, hence, additionally secured against dropping from its attached position on the pacifier shield 2.

As can further be seen particularly in FIG. 2, the attaching member 10 is snapped into the pacifier shield 2 in such a way that the lip-contact surface 11' of the lip-contact plate 11 adjoins flush the pacifier shield 2 surrounding the attaching member 10. Furthermore, the pacifier shield 2 and the attaching member 10 are acting together in such a way that a substantially gap-free transition between the lip-contact surface 11 and the surrounding pacifier shield 2 is ensured. Furthermore, in order to improve the user comfort of the pacifier 1, knob-like elevations 20 with a height of approximately 0.5 mm and a diameter of approximately 2 mm are provided on the lip-contact surface 11 to prevent the pacifier 1 from resting fully on the contact region of the child's lips; this way, skin irritations can be reliably avoided.

As can also be seen particularly in FIG. 2, the bulge 7 receiving the attaching member 10 is shaped relatively flat in order to provide the centre of gravity of the pacifier 1 as close to the mouth as possible. Here, the distance a between the outermost elevation 7" of the bulge 7 and the lip-contact surface 11' in the exemplary embodiment shown above is substantially only 11 mm.

An alternative exemplary embodiment is shown in FIG. 2*a*, wherein here the attaching member 10 and the teat 5 are formed integrally as a two-component injection-moulded part. In this case, the teat can be made of materials such as latex, silicone or a thermoplastic elastomer and the attaching member 10, on the other hand, can be made of more rigid plastic materials such as thermoplastics or more rigid elastomers. Due to the integral forming as a two-component injection-moulded part, the required space is reduced the and the bulge 7 can thus be configured even flatter than in the exemplary embodiment described above. Here, the distance a between the outermost elevation 7" of the bulge 7 and the lip-contact surface 11' can be substantially reduced down to 5 mm.

In FIGS. 7 and 8, an alternative exemplary embodiment of the pacifier 1 is shown, wherein not a pivotably mounted bow-shaped handle portion 17, but a substantially U-shaped handle portion 21 is snapped torque-proof onto the ribs 15, which are passed through the pacifier shield 2. For this, the U-shaped handle portion 21 comprises receiving slits 23 in its arms 22, into which the ribs 15 can be inserted. For a reliable snap connection, projecting pivots 24 are provided in the slit-shaped receiving openings 23, which pivots are received by the attaching holes 19 of the ribs 15 in the snapped-on position.

In FIGS. 10-12, a pacifier 1 is shown, which—in contrast to conventional pacifiers—does not have a teat 5 comprised of a hollow body, but a teat 5 which is formed substantially solid in the cross-section of its shaft-shaped shaft region 5', which adjoins the teat portion. Hereby, a reduction of the thickness and/or height of the shaft region 5' of the teat 5 can be achieved. The solid-walled configuration of the shaft region 5' is disrupted merely by a ventilation canal 25, which has a comparably small cross-section. This ventilation canal 25 opens out into the attaching opening 8 of the teat 5, in which the plug 9 is received. The attachment of a teat 5 comprising a substantially solid shaft region 5' therefore remains substantially unchanged from conventional hollow body teats, as shown in FIGS. 1-3. Here as well, an attaching member 10 is provided on a face of the pacifier shield 2 intended for contact with the lips, which attaching member is engaged with the pacifier shield 2 via latching lugs 10'. In FIG. 12 the snapped-on attachment of the bow-shaped handle portion 17 can be seen as well, forming an additional securing of the attaching member 10 to the pacifier shield 2.

In FIG. 13, yet another exemplary embodiment of a pacifier 1 is shown, comprising a shaft 5' that is formed solidly in its cross-section, with the teat 5 here having a substantially annular teat portion.

It is substantial, however, to provide an attaching member 10 which is attachable to the teat face of the pacifier shield in order to arrange the centre of gravity of the pacifier 1 in its used position as close to the mouth as possible and thus prevent an undesired tilting and dropping of the pacifier 1 as effective as possible when a comparably weak sucking power is applied.

The invention claimed is:

1. A pacifier with a teat, which is connectable at a shaft-shaped end to a pacifier shield by an attaching flange, wherein said pacifier shield has an inner face intended for the lips to be placed thereon, on which inner face an attaching member that is connected and/or connectable to said attaching flange is provided, wherein the attaching member can be snapped on in a recess in the pacifier shield, so that when said attaching member is attached to said pacifier shield, said teat is connected to said pacifier shield, wherein the attaching member has a lip-contact plate with a lip-contact surface, the lip contact surface facing the teat and being arranged in alignment with the inner face of the pacifier shield when attached to said pacifier shield, wherein for clamping attachment of said teat a plug that projects into an attaching opening of said teat is provided in a bulge of said pacifier shield that is intended to receive said attaching flange, and wherein the attaching member has at least one attaching rib extending substantially vertically to the lip-contact plate in order to snap-connect to the pacifier shield.

2. The pacifier according to claim 1, wherein the attaching member is a clamping member with a central through opening for the shaft-shaped end of the teat, so that when said attaching member is attached to the pacifier shield, said teat is being clamped between attaching member and pacifier shield.

3. The pacifier according to claim 2, wherein when the attaching member is attached to the pacifier shield, an attaching flange on the end face of the teat is arranged in a cavity between pacifier shield and clamping member.

4. The pacifier according to claim 1, wherein the attaching member and the teat, which is made of a soft material compared to said attaching member, are formed integrally as a two-component injection-moulded part.

5. The pacifier according to claim 1, wherein the teat is hollow and the pacifier shield comprises the plug that projects into the attaching opening of said teat.

6. The pacifier according to claim 5, wherein the plug is formed integrally with the pacifier shield.

7. The pacifier according to claim 1, wherein the distance (a) between the lip-contact surface and an outermost elevation of the pacifier shield is smaller than 15 mm, preferably smaller than 12 mm, in particular substantially between 5 mm and 11 mm.

8. The pacifier according to claim 7, wherein the attaching member has at least one attaching rib extending substantially vertically to the lip-contact plate in order to snap-connect to the pacifier shield.

9. The pacifier according to claim 1, wherein knob-shaped elevations are provided on the lip-contact surface of the attaching member.

10. The pacifier according to claim 1, wherein the attaching member comprises at least one projection, which extends through a recess in the pacifier shield when said attaching member is attached to said pacifier shield, wherein preferably a handle portion is attached to said projection in order to secure said attaching member on said pacifier shield.

11. The pacifier according to claim 10, wherein at least two ribs are provided as the projection.

12. The pacifier according to claim 11, wherein the ribs extend substantially vertically to the lip-contact plate.

13. The pacifier according to claim 11, wherein each of the ribs comprises an attaching hole in the freely cantilevering end region.

14. The pacifier according to claim 13, wherein for pivotably mounting a bow-shaped handle portion, attaching pins of the handle portion are received by the attaching holes of the ribs.

15. The pacifier according to claim 11, wherein a substantially U-shaped handle portion is snapped onto the ribs.

16. The pacifier according to claim 15, wherein the arms of the U-shaped handle portion comprise slit-shaped openings on their end faces for snap-connecting to the ribs.

17. The pacifier according to claim 11, wherein the ribs extend substantially vertically to the lip-contact plate and wherein each of the ribs comprises an attaching hole in the freely cantilevering end region.

18. The pacifier according to claim 11, wherein the ribs extend substantially vertically to the lip-contact plate, wherein each of the ribs comprises an attaching hole in the freely cantilevering end region, and wherein for pivotably mounting a bow-shaped handle portion attaching pins of the handle portion are received by the attaching holes of the ribs.

* * * * *